US008579780B2

(12) United States Patent
Senbo

(10) Patent No.: US 8,579,780 B2
(45) Date of Patent: Nov. 12, 2013

(54) PLASTIC BAG MAKING APPARATUS

(75) Inventor: Tomohiko Senbo, Kyoto (JP)

(73) Assignee: Totani Corporation, Kyoto (JP)

( * ) Notice: Subject to any disclaimer, the term of this patent is extended or adjusted under 35 U.S.C. 154(b) by 251 days.

(21) Appl. No.: 13/046,046

(22) Filed: Mar. 11, 2011

(65) Prior Publication Data

US 2012/0231941 A1 Sep. 13, 2012

(51) Int. Cl.
*B31B 1/64* (2006.01)

(52) U.S. Cl.
USPC ..... 493/189; 493/197; 493/231; 493/374

(58) Field of Classification Search
USPC ..... 493/186, 189, 194, 197, 199, 200, 205, 493/210, 231, 243, 374, 379
See application file for complete search history.

(56) References Cited

U.S. PATENT DOCUMENTS 6,425,847 B1 * 7/2002 Broenstrup ..... 493/231
7,331,917 B2 * 2/2008 Totani ..... 493/244

FOREIGN PATENT DOCUMENTS

EP 2277790 1/2006
WO 2010055571 5/2010

* cited by examiner

*Primary Examiner* — Hemant M Desai
(74) *Attorney, Agent, or Firm* — Kirschstein, et al.

(57) ABSTRACT

A sheet of side gusset material 3 is folded into halves, superposed into two layers and interposed between webs of panel material 1 and 2. One of the webs of panel material 1 is folded along a longitudinal folded line 8 to make the webs of panel material 1 and 2 open and make an open surface formed on the webs of panel material 1 and 2. One of the layers of side gusset material 3 is folded along the longitudinal folded line 8 to make the layers of side gusset material 3 open along with an auxiliary gusset portion 7 and make an open surface formed on the layers of auxiliary gusset portion 7. A web of bottom gusset material 4 is superposed on the open surfaces of panel material 1 and 2 and auxiliary gusset portion 7. The web of bottom gusset material 4 and the auxiliary gusset portion 7 are heat sealed with each other while the webs of panel material 1 and 2 and the sheet of side gusset material 3 are heat sealed with each other widthwise of the webs of panel material 1 and 2 with the open surfaces kept being formed. The web of bottom gusset material 4 and at least one of the webs of panel material 1 are heat sealed with each other longitudinally of the webs of panel material 1 and 2 with the open surfaces kept being formed.

1 Claim, 5 Drawing Sheets

PLASTIC BAG MAKING APPARATUS

TECHNICAL FIELD

The invention relates to an apparatus for successively making plastic bags.

BACKGROUND

An apparatus has heretofore been developed and proposed to successively make plastic bags each of which includes panel portions, side gusset portions and a bottom gusset portion, as disclosed in U.S. Pat. No. 7,331,917. Each of the side gusset portions has opposite end portions at one of which an auxiliary gusset portion is formed. The bottom gusset portion is combined with the auxiliary gusset portion. The plastic bag is called a rectangular bottom bag.

In the apparatus, webs of panel material are superposed on each other and fed longitudinally thereof and intermittently. The panel portions are formed by the webs of panel material. A sheet of side gusset material is folded into halves, superposed into two layers and then supplied to and interposed between the webs of panel material to extend widthwise thereof whenever the webs of panel material are fed intermittently. The sheet of side gusset material has opposite end portions. The side gusset portion is formed by the sheet of side gusset material.

In addition, one of the webs of panel material is temporarily fixed to one of the layers of side gusset material while the other web of panel material is temporarily fixed to the other layer of side gusset material at one of the end portions of side gusset material after the sheet of side gusset material is interposed. Furthermore, the apparatus includes panel material guide means by which the webs of panel material are guided to be folded respectively when being fed. One of the webs of panel material is folded along a longitudinal folded line when being fed to make the webs of panel material open and make an open surface formed on the webs of panel material. One of the layers of side gusset material is pulled by one of the webs of panel material to be folded along the longitudinal folded line to make the layers of side gusset material open along with the auxiliary gusset portion and make an open surface formed on the layers of auxiliary gusset portion. The other web of panel material is folded along a longitudinal folded line when being fed to make a folded portion formed in the other web of panel material and superposed on the open surfaces of panel material and auxiliary gusset portion. The folded portion is used as a web of bottom gusset material by which the bottom gusset portion is formed.

In addition, the web of bottom gusset material or the folded portion is folded back along a longitudinal folded back line and into halves when being fed. At the same time, one of the webs of panel material is unfolded so that the web of bottom gusset material can be interposed between the webs of panel material. The web of bottom gusset material and the auxiliary gusset portion are then heat sealed with each other while the webs of panel material and the sheet of side gusset material are heat sealed with each other widthwise of the webs of panel material whenever the webs of panel material are fed intermittently. The web of bottom gusset material and at least one of the webs of panel material are heat sealed with each other longitudinally of the webs of panel material whenever the webs of panel material are fed intermittently.

However, the apparatus has not only to make one of the webs of panel material folded, make the open surfaces formed and make the web of bottom gusset material superposed but also to make the web of bottom gusset material folded back and make one of the webs of panel material unfolded so that the web of bottom gusset material can be interposed between the webs of panel material. Accordingly, the panel material guide means must be complicated in structure. It is therefore desired to successively make the rectangular bottom bags in a way different from the apparatus.

It is therefore an object of the invention to provide an apparatus for successively making plastic bags each of which includes panel portions, side gusset portions and a bottom gusset portion, in a way different from the prior art.

Another object is to provide the apparatus which has only to make one of the webs of panel material folded, make the open surfaces formed and make the web of bottom gusset material superposed and has neither to make the web of bottom gusset material folded back nor to make one of the webs of panel material unfolded.

SUMMARY OF THE INVENTION

According to the invention, the apparatus is arranged to successively make plastic bags each of which includes panel portions, side gusset portions and a bottom gusset portion. Each of the side gusset portions has opposite end portions at one of which an auxiliary gusset portion is formed. The bottom gusset portion is combined with the auxiliary gusset portion.

The apparatus includes panel material feeding means by which webs of panel material are superposed on each other and fed longitudinally thereof and intermittently. The panel portions are formed by the webs of panel material. The apparatus further includes side gusset material supply means by which a sheet of side gusset material is folded into halves, superposed into two layers and then supplied to and interposed between the webs of panel material to extend widthwise thereof whenever the webs of panel material are fed intermittently. The sheet of side gusset material has opposite end portions. The side gusset portion is formed by the sheet of side gusset material. The apparatus further includes temporarily fixing means by which one of the webs of panel material is temporarily fixed to one of the layers of side gusset material while the other web of panel material is temporarily fixed to the other layer of side gusset material at one of the end portions of side gusset material after the sheet of side gusset material is interposed. The apparatus further includes panel material guide means by which one of the webs of panel material is guided to be folded along a longitudinal folded line at one of the end portions of side gusset material when being fed to make the webs of panel material open and make an open surface formed on the webs of panel material. One of the layers of side gusset material is pulled by one of the webs of panel material to be folded along the longitudinal folded line to make the layers of side gusset material open along with the auxiliary gusset portion and make an open surface formed on the layers of auxiliary gusset portion. The apparatus further includes bottom gusset portion forming means by which a web of bottom gusset material is superposed on the open surfaces of panel material and auxiliary gusset portion to extend longitudinally of the webs of panel material. The bottom gusset portion is formed by the web of bottom gusset material. The apparatus further includes cross seal means by which the web of bottom gusset material and the auxiliary gusset portion are heat sealed with each other while the webs of panel material and the sheet of side gusset material are heat sealed with each other widthwise of the webs of panel material whenever the webs of panel material are fed intermittently and with the open surfaces kept being formed. The apparatus further includes longitudinal seal means by which the web of bottom gusset material and at least one of the webs of panel material are heat sealed with each other longitudinally of the webs of panel material whenever the webs of panel material are fed intermittently and with the open surfaces kept being formed.

In a preferred embodiment, the apparatus further includes a cutter by which the web of bottom gusset material, the webs of panel material and the sheet of side gusset material are cut widthwise of the webs of panel material whenever the webs of panel material are fed intermittently and with the open surfaces kept being formed.

The sheet of side gusset material is folded at an angle of 45° at one of the end portions thereof to make the auxiliary gusset portion formed before the sheet of side gusset material is supplied to the webs of panel material.

The sheet of side gusset material may be folded at an angle of 45° at one of the end portions thereof to make the auxiliary gusset portion formed when one of the layers of side gusset material is folded along the longitudinal folded line to make the layers of side gusset material open.

One of the webs of panel material has opposite side edges. The other web of panel material has opposite side edges one of which protrudes beyond the corresponding side edge of one of the webs of panel material at a distance widthwise of the webs of panel material when the webs of panel material are superposed on each other. The bottom gusset portion forming means comprises additional guide means by which the other web of panel material is guided to be folded along a longitudinal folded line when being fed to make a folded portion formed in the other web of panel material and superposed on the open surfaces of panel material and auxiliary gusset portion. The web of bottom gusset material comprises the folded portion.

The longitudinal seal means comprises a longitudinal seal bar and a plate. One of the webs of panel material is folded along the longitudinal folded line to be superposed into two layers. The plate is interposed between the layers of panel material. The web of bottom gusset material and one of the webs of panel material are sandwiched between the longitudinal seal bar and the plate to be heat sealed with each other.

BEST MODE TO CARRY OUT THE INVENTION

Embodiments of the invention are as follows.

Figure 1:
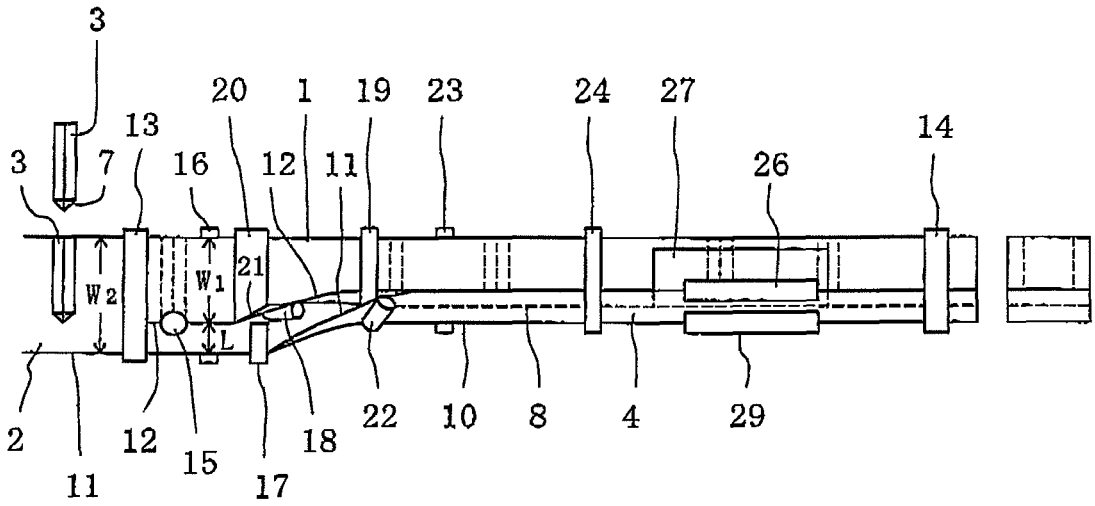
FIG. 1 is a plan view of a preferred embodiment of the invention.
Figure 3:
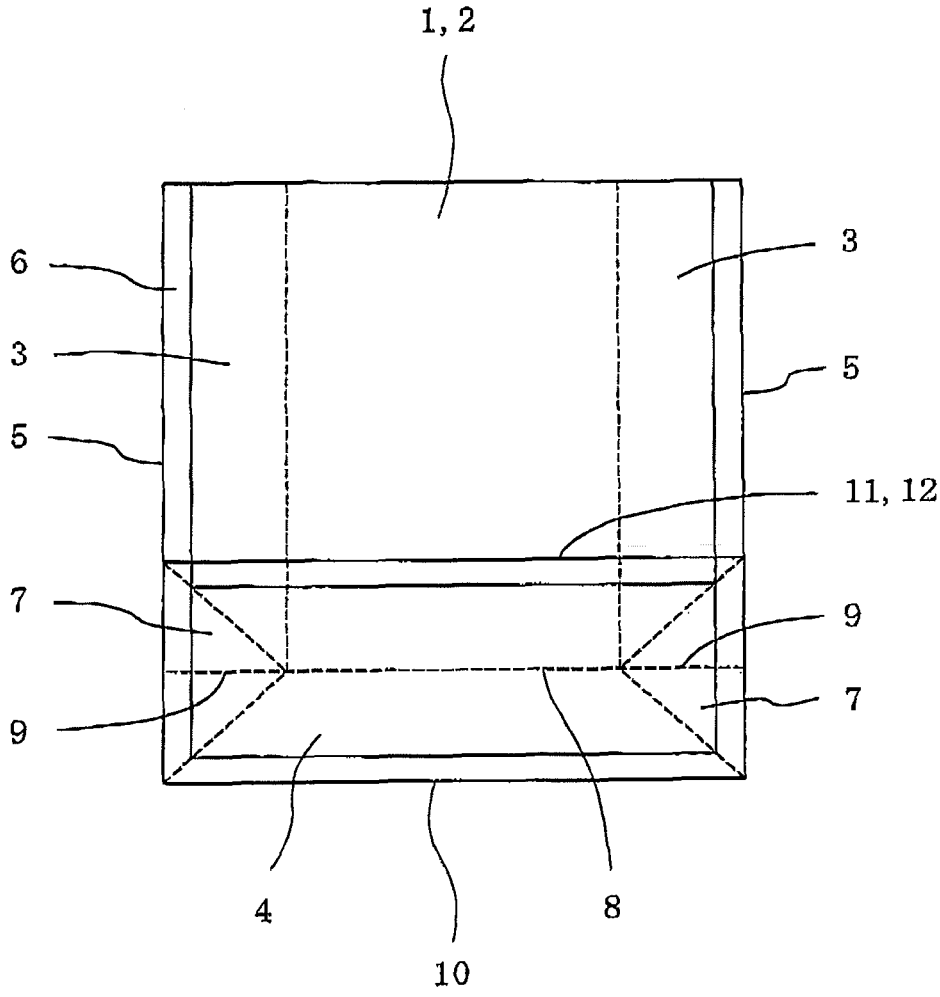
FIG. 3 is an explanatory view of the plastic bag obtained by the apparatus of FIG. 1.
Figure 4:
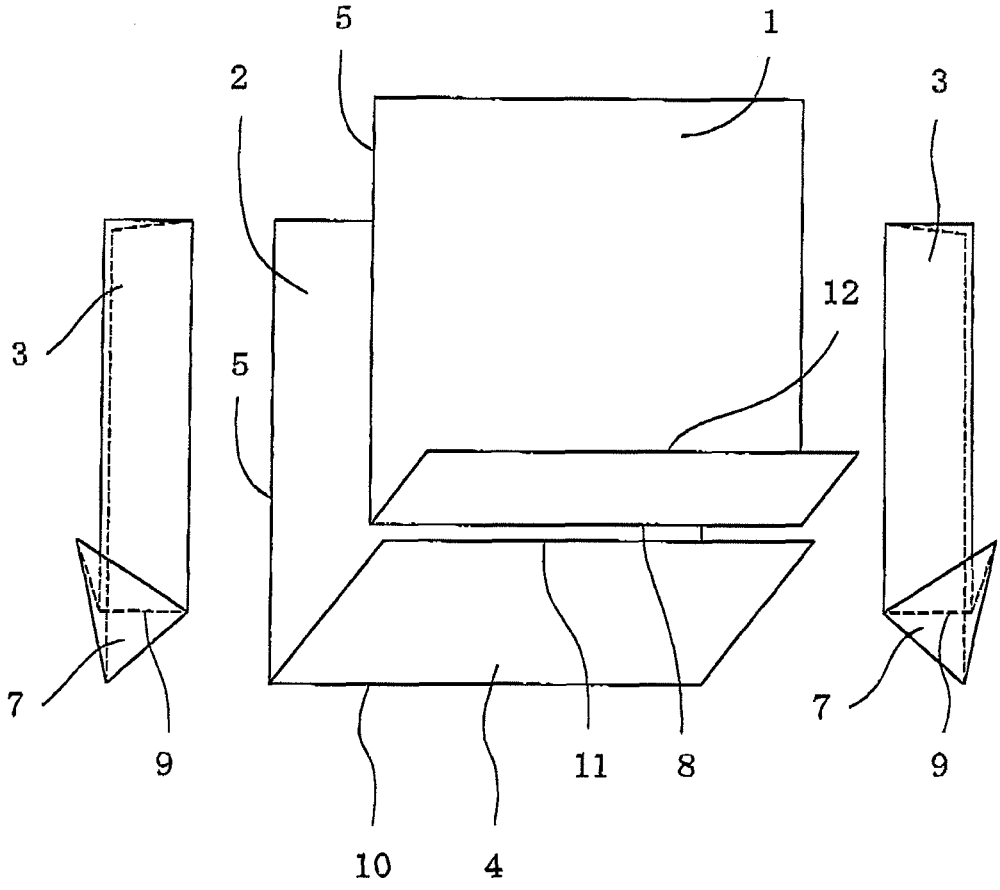
FIG. 4 is an explosive view of the plastic bag of FIG. 3.

Turning now to the drawings, FIG. 1 illustrates an apparatus for successively making plastic bags, according to the invention. Each of the plastic bags includes panel portions 1 and 2, side gusset portions 3 and a bottom gusset portion 4, as shown in FIG. 3 and as in the case of the plastic bag of U.S. Pat. No. 7,331,917. The panel portions 1 and 2 are superposed on each other to have opposite side edges 5 along which the side gusset portions 3 extend, as shown in FIG. 4. The side gusset portions 3 are folded into halves, superposed into two layers and interposed between the panel portions 1 and 2. The panel portions 1 and 2 and the side gusset portions 3 are heat sealed with each other along the side edges 5 of panel portions 1 and 2 so that heat sealed lines 6 can be formed along the side edges 5. In addition, each of the side gusset portions 3 has opposite end portions at one of which an auxiliary gusset portion 7 is formed. The side gusset portion 3 is folded at an angle of 45° at one of the end portions thereof to make the auxiliary gusset portion 7 formed, as also in the case of the plastic bag of the U.S. Patent.

Furthermore, one of the panel portions 1 is folded along a widthwise folded line 8 to make the panel portions 1 and 2 open and make an open surface formed on the panel portions 1 and 2. One of the layers of side gusset portion 3 is folded along a widthwise folded line 9 to make the layers of side gusset portion 3 open along with the auxiliary gusset portion 7 and make an open surface formed on the layers of auxiliary gusset portion 7. The bottom gusset portion 4 is superposed on the open surfaces of panel portions 1 and 2 and auxiliary gusset portion 7. In this connection, it should be understood that the bottom gusset portion 4 is not folded into halves and interposed between the panel portions 1 and 2, unlike the plastic bag of the U.S. Patent in which the bottom gusset portion 4 is folded into halves and interposed between the panel portions 1 and 2. The bottom gusset portion 4 is therefore combined with the auxiliary gusset portion 7, in a way different from the plastic bag of the U.S. Patent.

In addition, the other panel portion 2 is folded along a widthwise folded line 10 to make a folded portion 4 formed in the other panel portion 2, as in the case of the plastic bag of the U.S. Patent. The bottom gusset portion 4 comprises the folded portion and includes a free side edge 11. One of the panel portions 1 includes a bottom edge 12 with which the free side edge 11 is coincided. The bottom gusset portion 4 and the auxiliary gusset portion 7 are heat sealed with each other along the side edges 5 of panel portions 1 and 2 so that a heat sealed line 6 can be formed along the side edges 5. The bottom gusset portion 4 and one of the panel portions 1 are heat sealed with each other along the free side edge 11 and bottom edge 12 thereof so that a heat sealed line 6 can be formed along the free side edge 11 and bottom edge 12.

The bottom gusset portion 4 and the other panel portion 2 may be heat sealed with each other along the folded line 10 of panel portion 2 so that a heat sealed line 6 can be formed along the folded line 10.

The plastic bag can therefore be enlarged by the side gusset portions 3 to obtain an increased capacity, as in the case of the plastic bag of the U.S. Patent. A flat bottom surface is formed by the bottom gusset portion 4 to make the plastic bag stand stably.

Figure 2:
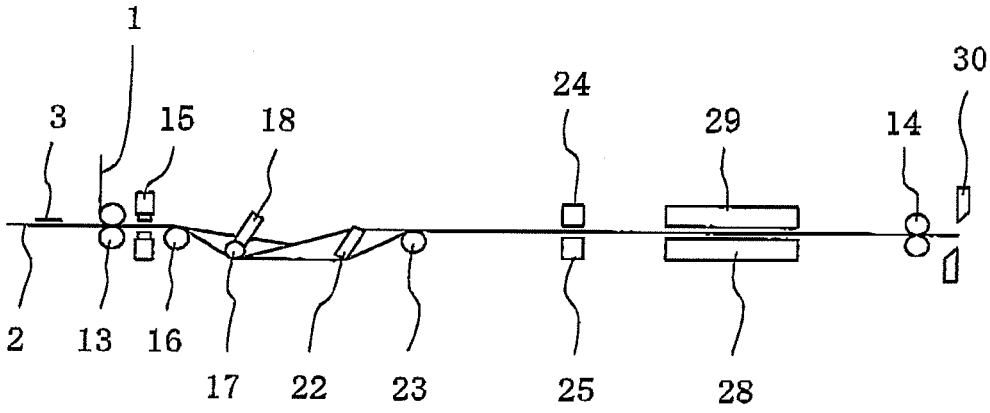
FIG. 2 is a side view of the apparatus of FIG. 1.

In order to successively make the plastic bags of FIG. 3, the apparatus includes panel material feeding means by which webs of panel material 1 and 2 are superposed on each other and fed longitudinally thereof and intermittently. The webs of panel material 1 and 2 comprise upper and lower webs of panel material comprising plastic films by which the panel portions 1 and 2 of FIG. 3 are formed. In the embodiment, the panel material feeding means comprises feeding rollers 13 and 14, as shown in FIG. 2. The upper web of panel material 1 is supplied downwardly and directed to the feeding rollers 13. The lower web of panel material 2 is supplied horizontally and directed to the feeding rollers 13 so that the webs of panel material 1 and 2 can be superposed on each other. The webs of panel material 1 and 2 are then directed to the feeding rollers 14. The feeding rollers 13 and 14 are rotated by a drive motor so that the webs of panel material 1 and 2 can be fed longitudinally thereof and intermittently.

The apparatus further includes side gusset material supply means by which a sheet of side gusset material 3 is folded into halves, superposed into two layers and then supplied to and interposed between the webs of panel material 1 and 2 to extend widthwise thereof whenever the webs of panel material 1 and 2 are fed intermittently. The sheet of side gusset material 3 has opposite end portions and comprises a plastic film by which the side gusset portion 3 of FIG. 3 is formed. In the embodiment, the sheet of side gusset material 3 has a double width, which is folded into halves on the opposite sides of the longitudinal centerline thereof to be superposed into two layers, as in the case of the apparatus of the U.S. Patent. In addition, the sheet of side gusset material 3 is folded at an angle of 45°, folded into halves, superposed into two layers and interposed between the layers of side gusset material 3 at one of the end portions thereof to make the auxiliary gusset portion 7 formed at the end portion. The sheet of side gusset material 3 is then supplied to and put on the lower web of panel material 2 to extend widthwise thereof whenever the webs of panel material 1 and 2 are fed intermittently. The sheet of side gusset material 3 is therefore interposed between the webs of panel material 1 and 2 when the webs of panel material 1 and 2 are superposed on each other. The side gusset material supply means has the same structure as that of the U.S. Patent. No reference is therefore made to the structure herein.

In addition, one of the webs of panel material 1 has opposite side edges. The other web of panel material 2 has opposite side edges one of which 11 protrudes beyond the corresponding side edge 12 of one of the webs of panel material 1 at a distance L widthwise of the webs of panel material 1 and 2 when the webs of panel material 1 and 2 are superposed on each other. In the embodiment, the upper web of panel material 1 has a small width W1 while the lower web of panel material 2 has a large width W2, as in the case of the apparatus of the U.S. Patent. Accordingly, the lower web of panel material 2 has one of the side edges 11 protruding beyond the corresponding side edge 12 of the upper web of panel material 1 at the distance L. The distance L is predetermined by and equal to the difference (W2−W1) between the widths W1 and W2 of the webs of panel material 1 and 2. The sheet of side gusset material 3 extends widthwise of the webs of panel material 1 and 2 and has a length corresponding to the width W1 of the upper web of panel material 1. In addition, the sheet of side gusset material 3 is disposed at a position corresponding to that of the upper web of panel material 1.

The apparatus further includes a temporarily fixing means by which one of the webs of panel material 1 is temporarily fixed to one of the layers of side gusset material 3 while the other web of panel material 2 is temporarily fixed to the other layer of side gusset material 3 at one of the end portions of side gusset material 3 after the sheet of side gusset material 3 is interposed. In the embodiment, the temporarily fixing means comprises point seal means 15 by which the upper web of panel material 1 is heat sealed or ultrasonic sealed with the upper layer of side gusset material 3 to be temporarily fixed thereto while the lower web of panel material 2 is heat sealed or ultrasonic sealed with the lower layer of side gusset material 3 to be temporarily fixed thereto at one of the end portions of side gusset material 3 whenever the webs of panel material 1 and 2 are fed intermittently, as also in the case of the apparatus of the U.S. Patent.

The apparatus further includes panel material guide means by which one of the webs of panel material 1 is guided to be folded along a longitudinal folded line 8 at one of the end portions of side gusset material 3 when being fed to make the webs of panel material 1 and 2 open and make an open surface formed on the webs of panel material 1 and 2. In the embodiment, the panel material guide means comprises guide rollers 16, 17, 18 and 19 and a plate 20, the webs of panel material 1 and 2 passing through the guide roller 16. One of the webs of panel material 1 is then directed to and lowered by the plate 20. The other web of panel material 2 is directed to and lowered by the guide roller 17. The plate 20 includes an inclined edge 21 with which one of the webs of panel material 1 is engaged. In addition, one of the webs of panel material 1 is directed to the guide roller 18 and guided by the inclined edge 21 and the guide roller 18 to be folded upwardly and vertically at one of the end portions of side gusset material 3. One of the webs of panel material 1 is then directed to and guided by the guide roller 19 to be folded completely to make the webs of panel material 1 and 2 open and make the open surface formed on the webs of panel material 1 and 2, as also in the case of the apparatus of the U.S. Patent.

In addition, one of the webs of panel material 1 is folded along the longitudinal folded line 8 at a width which is half as much as the distance L. The auxiliary gusset portion 7 has a length corresponds to the width at which one of the webs of panel material 1 is folded. Furthermore, one of the layers of side gusset material 3 is pulled by one of the webs of panel material 1 to be folded upwardly and vertically while the other layer of side gusset material is held by the other web of panel material 2 when one of the webs of panel material 1 is folded upwardly and vertically, because of being temporarily fixed. One of the layers of side gusset material 3 is therefore folded along the longitudinal folded line 8 to make the layers of side gusset material 3 open along with the auxiliary gusset portion 7 and make an open surface formed on the layers of auxiliary gusset portion 7, as also in the case of the apparatus of the U.S. Patent.

The apparatus further includes bottom gusset portion forming means by which a web of bottom gusset material 4 is superposed on the open surfaces of panel material 1 and 2 and auxiliary gusset portion 7 to extend longitudinally of the webs of panel material 1 and 2. In the embodiment, the other web of panel material 2 has one of the side edges 11 protruding beyond the corresponding side edge 12 of one of the webs of panel material 1 at the distance L, as described previously. The bottom gusset portion forming means comprises additional guide moans by which the other web of panel material 2 is guided to be folded along a longitudinal folded line 10 when being fed to make a folded portion 4 formed in the other web of panel material 2 and superposed on the open surfaces of panel material 1 and 2 and auxiliary gusset portion 7. It should be understood that in this case, the web of bottom gusset material 4 comprises the folded portion by which the bottom gusset portion 4 of FIG. 3 is formed. The other web of panel material 2 is folded along the longitudinal folded line 10 at a width corresponding to the length L so that the web of bottom gusset material 4 can be superposed on the open surfaces of panel material 1 and 2 and auxiliary gusset portion 7 to extend longitudinally of the webs of panel material 1 and 2. The web of bottom gusset material 4 includes a free side edge 11 coincided with the corresponding side edge 12 of one of the webs of panel material 1. In addition, in the embodiment, the additional guide means comprises guide rollers 17, 19, 22 and 23. The other web of panel material 2 is directed to and guided by the guide rollers 19 and 22 to be folded upwardly and vertically after being directed to and lowered by the guide roller 17. The webs of panel material 1 and 2 are then directed to and raised and guided by the guide roller 23 to make the other web of panel material 2 folded completely and make the folded portion 4 formed.

The apparatus further includes cross seal means 24 and 25 by which the web of bottom gusset material 4 and the auxiliary gusset portion 7 are heat sealed with each other while the webs of panel material 1 and 2 and the sheet of side gusset material 3 are heat sealed with each other widthwise of the webs of panel material 1 and 2 after the web of bottom gusset material 4 is superposed, whenever the webs of panel material 1 and 2 are fed intermittently and with the open surfaces kept being formed. For example, the cross seal means comprises a pair of cross seal bars 24 and 25 to which the web of bottom gusset material 4, the auxiliary gusset portion 7, the webs of panel material 1 and 2 and the sheet of side gusset material 3 are directed without making the web of bottom gusset material 4 folded back and without making one of the webs of panel material 1 unfolded, unlike the apparatus of the U.S. Patent in which the web of bottom gusset material 4 is folded back and one of the webs of panel material 1 is unfolded. The web of bottom gusset material 4, the auxiliary gusset portion 7, the webs of panel material 1 and 2 and the sheet of side gusset material 3 are therefore sandwiched between the cross seal bars 24 and 25 to be heat sealed with each other with the open surfaces kept being formed, making the heat sealed lines 6 of FIG. 3 formed.

The apparatus further includes longitudinal seal means 26, 27 and 28 by which the web of bottom gusset material 4 and at least one of the webs of panel material 1 are heat sealed with each other longitudinally of the webs of panel material 1 and 2 whenever the webs of panel material 1 and 2 are fed intermittently and with the open surfaces kept being formed. For example, the longitudinal seal means comprises a longitudinal seal bar 26, a plate 27, a receiver 28 and a longitudinal seal bar 29 to which the web of bottom gusset material 4 and the webs of panel material 1 and 2 are directed. One of the webs of panel material 1 has been folded along the longitudinal folded line 8 to be superposed into two layers. The plate 27 is interposed between the layers of panel material 1. The web of bottom gusset material 4 and the webs of panel material 1 and 2 are sandwiched between the longitudinal seal bar 26, the plate 27 and the receiver 28 at the free side edge 11 and corresponding side edge 12 of bottom gusset material 4 and panel material 1. The web of bottom gusset material 4 and one of the webs of panel material 1 are therefore sandwiched between the longitudinal seal bar 26 and the plate 27 to be heat sealed with each other. At the same time, the web of bottom gusset material 4 and the other web of panel material 2 may be sandwiched between the longitudinal seal bar 29 and the receiver 28 at the folded line 10 of panel material 2 to be heat sealed with each other. It should be understood that the web of bottom gusset material 4 and one of the webs of panel material 1 are heat sealed with each other along the free side edge 11 and corresponding side edge 12 of bottom gusset material 4 and panel material 1 while the web of bottom gusset material 4 and the other web of panel material 2 are heat sealed with each other along the folded line 10 of panel material 2, making the heat sealed lines 6 of FIG. 3 formed.

By the way, each of the webs of panel material 1 and 2 end the sheet of side gusset material 3 comprises a laminated film composed of a sealant laminated on a base material. The webs of panel material 1 and 2 have inner surfaces formed by the sealant such as polyethylene or polypropylene and outer surfaces formed by the base material such as nylon when being superposed on each other. The sheet of side gusset material 3 has outer surfaces formed by the sealant such as polyethylene or polypropylene and inner surfaces formed by the base material such as nylon when being folded into halves. The apparatus can therefore make the web of bottom gusset material 4 and the auxiliary gusset portion 7 heat sealed with each other and make the webs of panel material 1 and 2 and the sheet of side gusset material 3 heat sealed with each other by the cross seal bars 24 and 25. The apparatus can further make the web of bottom gusset material 4 and one of the webs of panel material 1 heat sealed with each other by the longitudinal seal bar 26 and make the web of bottom gusset material 4 and the other web of panel material 2 heat sealed with each other by the longitudinal seal bar 29.

The apparatus further includes a cutter 30 by which the web of bottom gusset material 4, the webs of panel material 1 and 2 and the sheet of side gusset material 3 are cut widthwise of the webs of panel material 1 and 2 whenever the webs of panel material 1 and 2 are fed intermittently and with the open surfaces kept being formed. In the embodiment; the web of bottom gusset material 4, the webs of panel material 1 and 2 and the sheet of side gusset material 3 pass through the feeding roller 14 to be directed to the cutter 30 after being heat sealed. The web of bottom gusset material 4, the webs of panel material 1 and 2 and the sheet of side gusset material 3 are cut along the longitudinal centerline of the sheet of side gusset material 3, making the side edges 5 of FIG. 3 formed.

The apparatus can therefore successively make plastic bags of FIG. 3. The plastic bag includes the widthwise folded lines 8 and 10 of FIG. 4 formed by the longitudinal folded lines 8 and 10 of panel material 1 and 2 and the free side edge 11 and bottom edge 12 of FIG. 4 formed by the free side edge 11 and corresponding side edge 12 of bottom gusset material 4 and panel material 1.

In the apparatus, the web of bottom gusset material 4 and the auxiliary gusset portion 7 are heat sealed with each other while the webs of panel material 1 and 2 and the sheet of side gusset material 3 are heat sealed with each other widthwise of the webs of panel material 1 and 2 with the open surfaces kept being formed, as described previously. The web of bottom gusset material 4 and at least one of the webs of panel material 1 are heat sealed with each other longitudinally of the webs of panel material 1 and 2 with the open surfaces kept being formed. The webs of bottom gusset material 4, the webs of panel material 1 and 2 and the sheet of side gusset material 3 are then cut widthwise of the webs of panel material 1 and 2 with the open surfaces kept being formed. Accordingly, in order to successively make the plastic bags each of which includes the side gusset portions 3 and the bottom gusset portion 4, the apparatus has only to make one of the webs of panel material 1 folded, make the open surfaces formed and make the web of bottom gusset material 4 superposed. The apparatus has neither to make the web of bottom gusset material 4 folded back nor to make one of the webs of panel material 1 unfolded unlike the apparatus of the U.S. Patent, so that the panel material guide means can be simple in structure.

Figure 5:
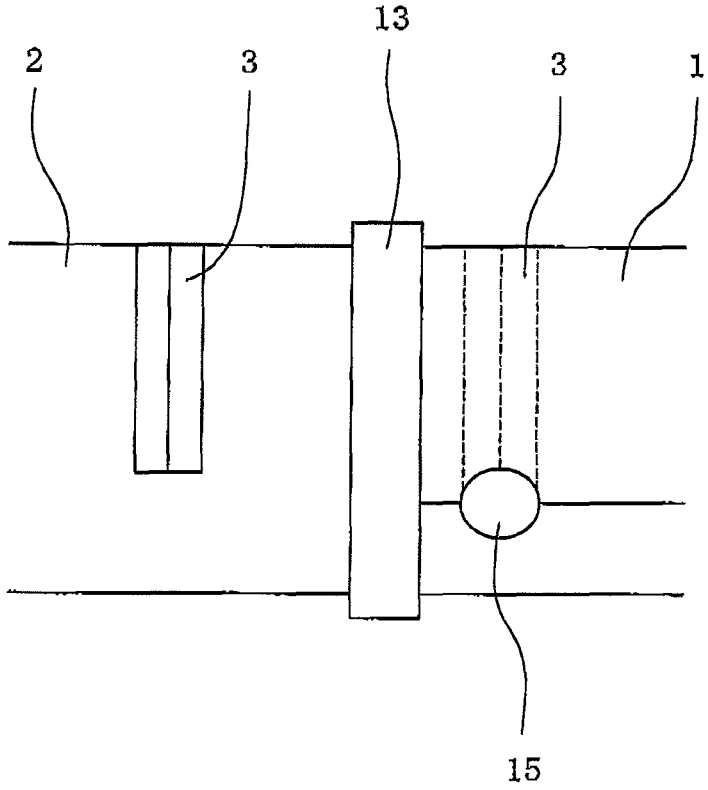
FIG. 5 is an enlarged view of another embodiment.

It is not always indispensable that the sheet of side gusset material 3 is folded at the angle of 45° at one of the end portions thereof to make the auxiliary gusset portion 7 formed before the sheet of side gusset material 3 is supplied to the webs of panel material 1 and 2, as described previously. The sheet of side gusset material 3 may be supplied to the webs of panel material 1 and 2 without making the auxiliary gusset portion 7 formed, as shown in FIG. 5. One of the webs of panel material 1 is then temporarily fixed to one of the layers of side gusset material 3 while the other web of panel material 2 is temporarily fixed to the other layer of side gusset material 3 at one of the end portions of side gusset material 3. In addition, one of the webs of panel material 1 is folded along the longitudinal folded line 8 so that one of the layers of side gusset material 3 can be pulled by one of the webs of panel material 1 to be folded. The sheet of side gusset material 3 is therefore folded at the angle of 45° at one of the end portions thereof to make the auxiliary gusset portion 7 formed when one of the layers of side gusset material 3 is folded along the longitudinal folded line 8 to make the layers of side gusset material 3 open, as also disclosed in the U.S. Patent.

It is also not always indispensable that the other web of panel material 2 is folded along the longitudinal folded line 10 to make the folded portion formed, the web of bottom gusset material 4 comprising the folded portion, as described previously. The bottom gusset material forming means may comprises bottom gusset supply means by which a web of bottom gusset material is supplied to the webs of panel material 1 and 2 and superposed on the open surfaces of panel material 1 and 2 and auxiliary gusset portion 7 to extend longitudinally of the webs of panel material 1 and 2.

In addition to the side gusset portions and the bottom gusset portion, the plastic bag may further include a top gusset portion, as disclosed in Japanese Patent Publication No. 4,108,846. The bottom gusset portion extends along the bottom edge of panel portion while the top gusset portion extends along top edge. In addition to the auxiliary gusset portion formed at one of the end portions of side gusset portion, an auxiliary gusset portion is formed at the other end portion. The top gusset portion is combined with the auxiliary gusset portion. In this case, the plastic bag can be shaped into a rectangular parallelepiped to have an appearance of box when being filled with content.

The apparatus may be arranged to successively make the plastic bags of the publication. In the apparatus, one of the webs of panel material 1 is temporarily fixed to one of the layers of side gusset material 3 while the other web of panel material 2 is temporarily fixed to the other layer of side gusset material 3 not only at one of the end portions of side gusset material 3 but also at the other end portion. One of the webs of panel material 1 is folded along the longitudinal folded line 8 at one of the end portions of side gusset material 3 to make the webs of panel material 1 and 2 open, make the open surface formed on the webs of panel material 1 and 2 and make the open surface formed on the layers of auxiliary gusset portion 7. The web of bottom gusset material 4 is superposed on the open surfaces of panel material 1 and 2 and auxiliary gusset portion 7. In addition, one of the webs of panel material 1 is folded along a longitudinal folded line at the other end portion of side gusset material 3 to make the webs of panel material 1 and 2 open, make an open surface formed on the webs of panel material 1 and 2 and make an open surface formed on the layers of auxiliary gusset portion. A web of top gusset material is superposed on the open surfaces of panel material 1 and 2 and auxiliary gusset portion. Furthermore, the webs of bottom gusset material and top gusset material and the auxiliary gusset portions are heat sealed with each other while the webs of panel material and the sheet of side gusset material are heat sealed with each other widthwise of the webs of panel material with the open surfaces kept being formed. The webs of bottom gusset material and top gusset material and at least one of the webs of panel material are heat sealed with each other longitudinally of the webs of panel material with the open surfaces kept being formed. The webs of bottom gusset material and top gusset material, the webs of panel material and the sheet of side gusset material are then cut widthwise of the webs of panel material with the open surfaces kept being formed. The apparatus can therefore successively make the plastic bags of the publication.

It should be understood that the invention covers the apparatus for successively making plastic bags of the publication.

What is claimed is:

1. An apparatus for successively making plastic bags each of which includes panel portions, side gusset portions and a bottom gusset portion, each of the side gusset portions having opposite end portions at one of which an auxiliary gusset portion is formed, the bottom gusset portion being combined with the auxiliary gusset portion, the apparatus comprising:

panel material feeding means by which webs of panel material are superposed on each other and fed longitudinally thereof and intermittently, the panel portions being formed by the webs of panel material;

side gusset material supply means by which a sheet of side gusset material is folded into halves, superposed into two layers and then supplied to and interposed between the webs of panel material to extend widthwise thereof whenever the webs of panel material are fed intermittently, the sheet of side gusset material having opposite end portions, the side gusset portion being formed by the sheet of side gusset material;

temporarily fixing means by which one of the webs of panel material is temporarily fixed to one of the layers of side gusset material while the other web of panel material is temporarily fixed to the other layer of side gusset material at one of the end portions of side gusset material after the sheet of side gusset material is interposed;

panel material guide means by which one of the webs of panel material is guided to be folded along a longitudinal folded line at one of the end portions of side gusset material when being fed to make the webs of panel material open and make an open surface formed on the webs of panel material, one of the layers of side gusset material being pulled by one of the webs of panel material to be folded along the longitudinal folded line to make the layers of side gusset material open along with the auxiliary gusset portion and make an open surface formed on the layers of the auxilary gusset portion;

bottom gusset portion forming means by which a web of bottom gusset material is superposed on the open surfaces of panel material and the auxiliary gusset portion to extend longitudinally of the webs of panel material, the bottom gusset portion being formed by the web of bottom gusset material;

cross seal means by which the web of bottom gusset material and the auxiliary gusset portion are heat sealed with each other while the webs of panel material and the sheet of side gusset material are heat sealed with each other widthwise of the webs of panel material whenever the webs of panel material are fed intermittently and with the open surfaces kept being formed; and longitudinal seal means by which the web of bottom gusset material and at least one of the webs of panel material are heat sealed with each other longitudinally of the webs of panel material whenever the webs of panel material are fed intermittently and with the open surfaces kept being formed, wherein one of the webs of panel material has opposite side edges, the other web of panel material having opposite side edges one of which protrudes beyond the corresponding side edge of one of the webs of panel material at a distance widthwise of the webs of panel material when the webs of panel material are superposed on each other, the bottom gusset portion forming means comprising additional guide means by which the other web of panel material is guided to be folded along a longitudinal folded line when being fed to make a folded portion formed in the other web of panel material and superposed on the open surfaces of panel material and the auxiliary gusset portion, the web of bottom gusset material comprising the folded portion.

* * * * *